US005101597A

United States Patent [19]

Pelachyk et al.

[11] Patent Number: 5,101,597

[45] Date of Patent: Apr. 7, 1992

[54] DOOR HANDLE BRACKET ATTACHMENT FOR VEHICLE DOOR

[75] Inventors: Richard Pelachyk, Utica; Timothy M. Farris, Sterling Heights; Dante C. Zuccaro, Allenton, all of Mich.

[73] Assignee: General Motors Corporation, Detroit, Mich.

[21] Appl. No.: 740,789

[22] Filed: Aug. 6, 1991

[51] Int. Cl.[5] ..... E05B 1/00

[52] U.S. Cl. ..... 49/460; 16/110 R; 16/DIG. 24

[58] Field of Search ..... 49/460; 16/110 R, DIG. 24, 16/DIG. 25, DIG. 41

[56] References Cited

U.S. PATENT DOCUMENTS

| | | | |
|---|---|---|---|
| 4,096,603 | 6/1978 | Klaus | 16/110 R |
| 4,641,462 | 2/1987 | Markus | 49/460 |
| 4,788,745 | 12/1988 | Wallis et al. | 49/460 X |
| 4,862,642 | 9/1989 | Alessi | 49/460 |
| 4,939,867 | 7/1990 | Harada et al. | 49/349 |

*Primary Examiner*—Philip C. Kannan

*Attorney, Agent, or Firm*—Charles E. Leahy

[57] ABSTRACT

A handle bracket intended for attachment on a vehicle door panel is a sheet metal stamping having a pair of spaced apart legs which carry spaced apart feet extending longitudinally and adapted to overlie the planar surface of the door panel. Each of the feet has a toe portion and a heel. The panel has a pair of toe straps struck from the panel and defining receptacles for receiving the toe portions of the feet when the feet are abutted with the panel and then slid longitudinally along the surface into the receptacles. The panel also has a pair of openings therein which register with the heel portions of the feet. The heels have integral retaining flaps bent forwardly from the underside thereof and being admitted through the openings in the panel to become engaged with the panel when the feet are abutted with the panel and then slid longitudinally along the surface. Thus the engagement of the toe portion in the toe straps and the engagement of the retaining flaps with the panel effectively attach the handle bracket to the panel.

4 Claims, 2 Drawing Sheets

DOOR HANDLE BRACKET ATTACHMENT FOR VEHICLE DOOR

The invention relates to attaching a door handle to a motor vehicle door and more particularly provides a handle bracket and door panel having integral structure by which a permanent attachment may be obtained without use of separate fastening devices.

BACKGROUND OF THE INVENTION

It is well known in motor vehicles to construct a vehicle door including a stamped metal door panel and to attach a handle assembly to the panel. The handle assembly is typically comprised of a mounting bracket having a handle pivotally attached thereto. Screws, bolts, or rivets are employed to attach the handle bracket to the door panel. Bent wire rods extend between the handles and the latch so that actuation of the handle actuates the door latch.

It would be desirable to provide a door panel and handle bracket which may be attached together without necessity for independent fastening devices such as screws, rivets and bolts.

SUMMARY OF THE INVENTION

According to the invention a handle bracket intended for attachment on a vehicle door panel is a sheet metal stamping having a pair of spaced apart legs which carry spaced apart feet extending longitudinally and adapted to overlie the planar surface of the door panel. Each of the feet has a toe portion and a heel. The panel has a pair of toe straps struck from the panel and defining receptacles for receiving the toe portions of the feet when the feet are abutted with the panel and then slid longitudinally along the surface into the receptacles. The panel also has a pair of openings therein which register with the heel portions of the feet. The heels have integral retaining flaps bent forwardly from the underside thereof and being admitted through the openings in the panel to become engaged with the panel when the feet are abutted with the panel and then slid longitudinally along the surface. Thus the engagement of the toe portion in the toe straps and the engagement of the retaining flaps with the panel effectively attach the handle bracket to the panel. The toe straps preferably include side walls which converge toward one another so that the toe portion of the feet become progressively engaged with the toe strap to effect tight fitting, rattle free engagement therebetween. In addition, retaining tangs are struck from the feet intermediate the toe portion and heel portion to engage with the openings in the panel to resist sliding of the feet along the panel. Dimples may be struck from the toe portions to wedge into engagement with the toe straps.

Accordingly, the object, feature, and advantage of the invention resides in the provision of a handle bracket having spaced apart legs with toes portions slidably engaged into toe straps struck from the panel and heel portions having retaining flaps which enter apertures in the door panel and become engaged with the door panel.

BRIEF DESCRIPTION OF THE DRAWINGS

These and other objects, features, and advantages of the invention will become apparent upon consideration of the description of the preferred embodiment, and the appended drawings in which.

DESCRIPTION OF THE PREFERRED EMBODIMENT

Figure 1:
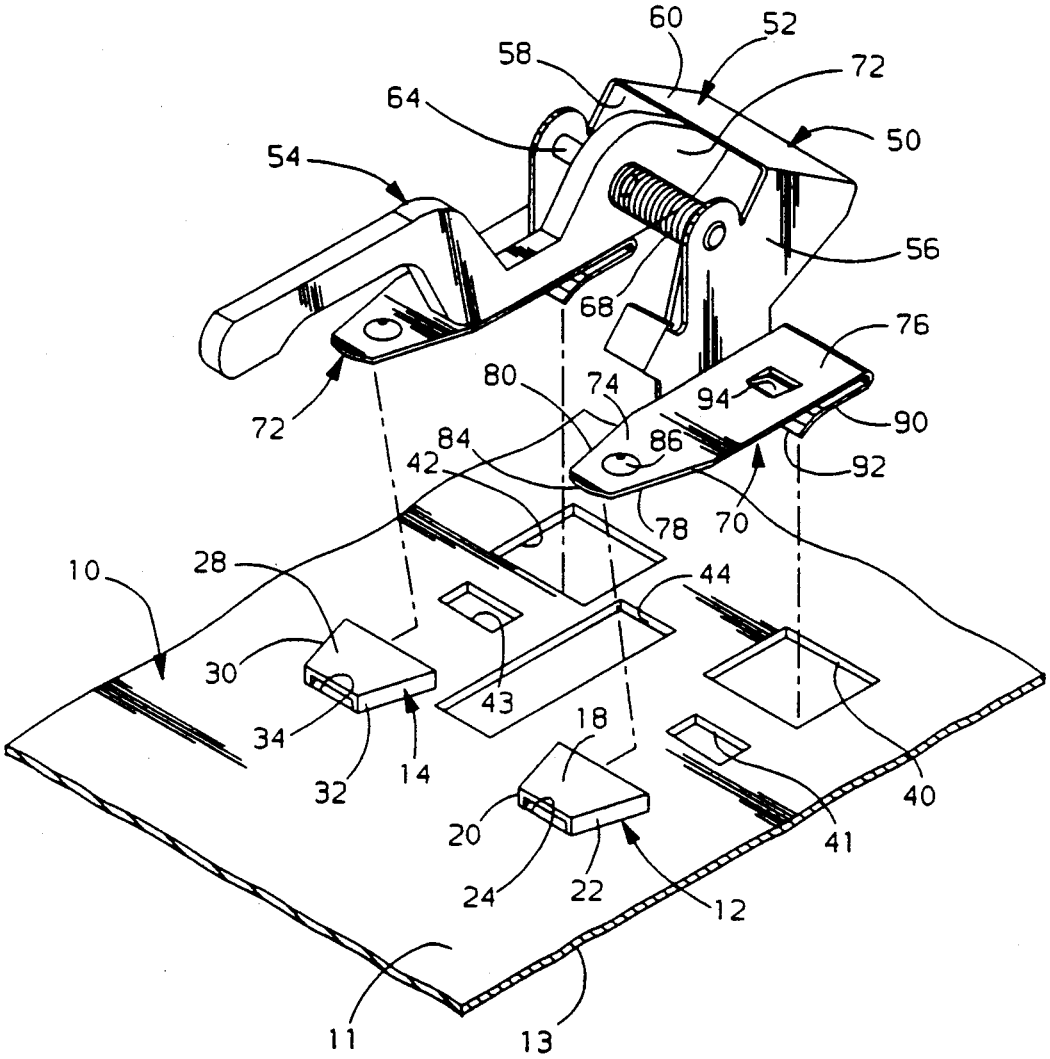
FIG. 1 is a perspective, exploded of the handle bracket and the panel.

FIG. 1 shows a portion of a vehicle door panel 10 which is conventionally stamped from sheet metal and has a surface 11 and underside 13. The door panel 10 has special features stamped therein to enable the fastenerless attachment of a door handle bracket thereto. In particular, a pair of toe straps 12 and 14 are struck from the panel 10 in the stamping press. The toe strap 12 includes a top wall 18 and a pair of side walls 20 and 22 which converge toward one another. Because the toe strap 12 is struck from the surface of the panel 10, an opening 24 is present beneath the toe strap 12. The toe strap 14 is similarly constructed including a top wall 28 and side walls 30 and 32 and an underlying opening 34.

The panel 10 also has a pair of rectangular heel openings 40 and 42 situated rearwardly of the toe straps 12 and 14 and a pair of intermediate openings 41 and 43 situated between the toe shapes and the heel openings. A clearance slot 44 is also provided in the panel 10 to prevent any interference with the pivoting movement of the door handle, as will be discussed hereinafter.

Referring again to FIG. 1, the door handle assembly generally indicated at 50 and includes a bracket 52 and a handle 54. The bracket 52 includes a pair of spaced apart legs 56 and 58 which are connected together by a cross member 60. A pivot shaft 64 has its ends staked or otherwise fixed to the legs 56 and 58. The handle 54 is preferably a die cast member and is pivotally mounted on the shaft 64. A coil spring 68 surrounds the shaft 64 and acts between the leg 56 and the handle 54 to urge the handle 54 in the counterclockwise direction as viewed in FIG. 1 so that the tail 72 of handle 54 engages with the underside of the cross member 60 to define the normal rest position of the handle 54.

As best seen in FIG. 1, the legs 56 and 58 respectively carry feet 70 and 72 at the lower ends thereof which are stamped integrally with the bracket 52. The foot 70 extends generally longitudinally and includes a toe portion 74 and a heel portion 76. The toe portion 74 has converging side walls 78 and 80 which generally match the angle of convergence of the side walls 20 and 22 of the toe strap 12 on the panel 10. The toe portion 74 has a tip 84 which is curled upward slightly. The toe portion 74 also has a dimple 86 struck upwardly from the surface thereof.

Figure 3:
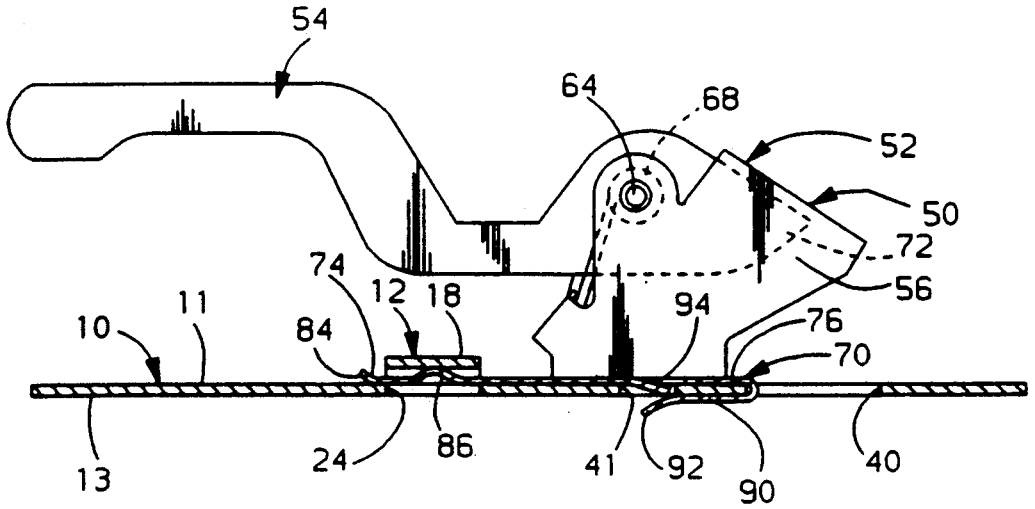
FIG. 3 is a cross section view taken in the direction of arrows 3—3 of FIG. 2.

As best seen in FIGS. 1 and 3, the heel portion 76 carries an integral retaining flap 90 which is bent forwardly therefrom and has a tip 92 which is bent downwardly. The foot 70 also has a retaining tang 94 struck downwardly intermediate the toe portion 74 and the heel portion 76 therefrom.

The foot 72 is constructed identically to the foot 70 and includes a toe portion with upturned tip and dimple, a heel portion with retaining flap, and a retaining tab.

Figure 2:
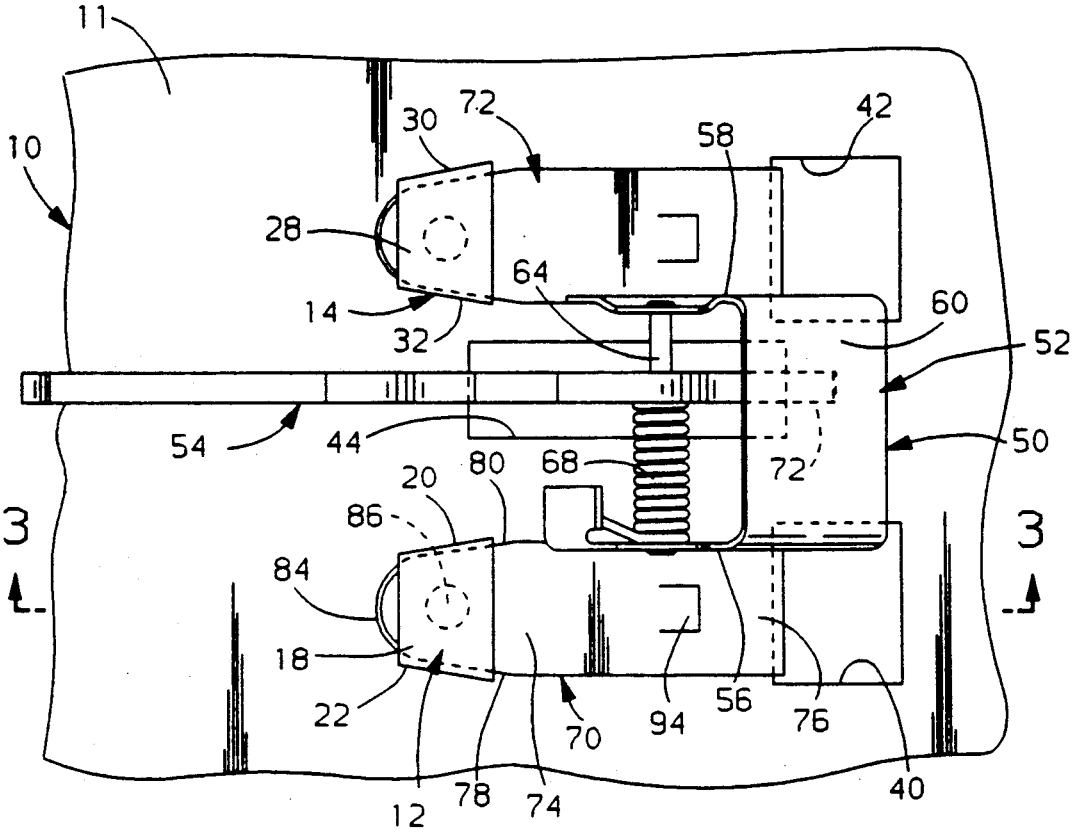
FIG. 2 is a side elevation view of the door panel having the handle bracket attached thereto.

Referring to FIG. 1, it will be appreciated that the aforedescribed bracket 52 may be attached to the panel 10 without necessity for any independent fastening devices. This attachment is accomplished by first lowering the bracket 52 from its FIG. 1 position into engagement with the surface 11 of panel 10 so that the retaining flap 90 will be lowered into the opening 42 in the panel. Then, the bracket 52 is slid leftwardly along the surface of the panel 10 causing the toe portion 74 to enter beneath the toe strap 12 as shown in FIGS. 2 and 3, while simultaneously the retaining flap 90 progresses leftwardly into engagement with the underside 13 of the panel 10. It will be appreciated that the upturned tip 84 of the toe portion 74 and the downturned tip 92 of the retaining flap 90 facilitate the leftward sliding motion of the bracket 52.

FIGS. 2 and 3 show the handle bracket 52 having been slid to the full leftward attached position with respect to the panel 10. As best seen in FIG. 2, the converging relationship of the side walls 20 and 22 of the toe strap 14 have cooperated with the converging of the side walls 78 and 80 of the toe portion 74 to obtain a tight fitting engagement therebetween. In addition, as shown in FIG. 3, the dimple 86 is engaged with the underside of the toe strap 28 to effectively restrain the foot 70 in tight fitting surface to surface engagement with the surface of the panel 10. Simultaneously the retaining flap 90 has become effectively engaged with the underside 13 of the panel. The retaining tang 94 of foot 74 engages with the intermediate opening 41 of the panel 10 to resist rightward motion of the handle assembly 50 which would disengage the bracket 52 from its attachment with the panel 10. The identical features of the foot 72 become likewise attached to the panel 11.

Thus it is seen that the invention provides a new and improved attachment device which is particularly suited for attaching a door handle bracket on a door panel without the necessity for use of independent fastening devices such as rivets, screws, and bolts. The attachment device can also be used in other applications in which it is desired to mount a bracket on a panel.

The stability of the door handle attachment onto the door is assured by locating the feet at a substantial stance from one another and also by providing the feet with a substantial length. In addition, the relationship between the toes and the toe straps and the relationship of the heel retaining flap to the openings provides a fixed and rattle free attachment of the bracket to the panel.

The embodiments of the invention in which an exclusive property or privilege is claimed are defined as follows:

1. In combination: a panel having a surface and an underside, and a bracket adapted for attachment on the panel, said bracket being a sheet metal stamping having a pair of spaced apart legs carrying spaced apart feet which extend longitudinally and are adapted to overlie the surface of the door panel, each of said feet having a toe portion and a heel portion, said panel having a pair of toe straps struck from the panel and respectively defining receptacles for receiving the toe portions of the feet when the feet are abutted with the panel and then slid longitudinally along the surface, and said panel having a pair of openings therein registering with the heel portion of the feet, and said heels having integral retaining flaps bent forwardly therefrom and being admitted through the openings in the panel when the feet are abutted with the panel to become engaged with the underside of panel when the feet are slid longitudinally along the surface, whereby the handle bracket is attached to the door panel.

2. The combination of claim 1 further characterized by said toe portions having dimples struck therein by which the feet are wedged into engagement with the toe straps.

3. The combination of claim 1 further characterized by said toe straps having side walls which converge toward one another so that the toe portion of the feet become progressively engaged with the toe straps to effect tight fitting rattle free engagement of the feet with the toe panel.

4. The combination of claim 1 further characterized by said feet having retaining tangs struck therefrom intermediate the toe portion and the heel portion and engaging with mating openings provided in the panel to resist sliding of the feet along the panel so that the attachment of the bracket to the panel is maintained.

* * * * *